US010070229B2

(12) United States Patent
Kono

(10) Patent No.: US 10,070,229 B2
(45) Date of Patent: Sep. 4, 2018

(54) EXCITER

(71) Applicant: CLARION CO., LTD., Saitama-shi (JP)

(72) Inventor: Kenji Kono, Itabashi-ku (JP)

(73) Assignee: CLARION CO., LTD., Saitama-Shi (JP)

( * ) Notice: Subject to any disclaimer, the term of this patent is extended or adjusted under 35 U.S.C. 154(b) by 0 days.

(21) Appl. No.: 15/505,613

(22) PCT Filed: Oct. 1, 2015

(86) PCT No.: PCT/JP2015/077910

§ 371 (c)(1),
(2) Date: Feb. 22, 2017

(87) PCT Pub. No.: WO2016/052695

PCT Pub. Date: Apr. 7, 2016

(65) Prior Publication Data

US 2018/0054679 A1 Feb. 22, 2018

(30) Foreign Application Priority Data

Oct. 3, 2014 (JP) ..... 2014-204601

(51) Int. Cl.
*H04R 9/06* (2006.01)
*H04R 1/28* (2006.01)
(Continued)

(52) U.S. Cl.
CPC ..... *H04R 9/06* (2013.01); *H04R 1/288* (2013.01); *H04R 7/127* (2013.01); *H04R 7/18* (2013.01);
(Continued)

(58) Field of Classification Search
CPC ..... H04R 1/288; H04R 7/127; H04R 7/18; H04R 9/022; H04R 9/025; H04R 9/045;
(Continued)

(56) References Cited

U.S. PATENT DOCUMENTS 5,604,816 A * 2/1997 Totani ..... A61H 23/0236 381/396
6,570,993 B1 * 5/2003 Fukuyama ..... G10K 9/22 340/388.1
(Continued)

FOREIGN PATENT DOCUMENTS

DE 10 2011 086978 6/2012
GB 2 289 596 11/1995
(Continued)

OTHER PUBLICATIONS

International Search Report for corresponding International Application No. PCT/JP2015/077910, dated Dec. 1, 2015.
(Continued)

*Primary Examiner* — Huyen D Le
(74) *Attorney, Agent, or Firm* — Mori & Ward, LLP

(57) ABSTRACT

An exciter (1) includes a vibrator (2) including a yoke and a magnet, a frame (3) incorporating the vibrator (2) with a damper (4) therebetween, and a voice coil bobbin (5) disposed inside the frame (3) and having another end (5*b*) that extends to near the vibrator (2) and is provided with a voice coil (11). The frame (3) has an opening (3*b*), and the voice coil bobbin (5) is mounted on the edge of the opening (3*b*). One end (5*a*) of the voice coil bobbin (5) is opened to the outside of the frame (3). The voice coil bobbin (5) is provided with a vibrating member (10) that covers the opened portion.

7 Claims, 7 Drawing Sheets

(51) Int. Cl.

| | |
|---|---|
| ***H04R 7/18*** | (2006.01) |
| ***H04R 9/02*** | (2006.01) |
| ***H04R 9/04*** | (2006.01) |
| ***H04R 7/12*** | (2006.01) |
| ***H04R 11/02*** | (2006.01) |

(52) U.S. Cl.
CPC ..... *H04R 9/022* (2013.01); *H04R 9/025* (2013.01); *H04R 9/045* (2013.01); *H04R 9/066* (2013.01); *H04R 11/02* (2013.01); *H04R 2400/03* (2013.01); *H04R 2400/07* (2013.01); *H04R 2400/11* (2013.01)

(58) Field of Classification Search
CPC ..... H04R 9/06; H04R 2209/027; H04R 2400/03; H04R 2400/07; H04R 2400/11; H04R 2499/11
USPC ..... 381/151, 152, 386, 396, 397, 398, 400, 381/403, 404, 405, 412, 423, 424, 430, 381/433, 353, 354; 181/171, 172, 173
See application file for complete search history.

(56) References Cited

U.S. PATENT DOCUMENTS

| | | | | |
|---|---|---|---|---|
| 6,618,487 | B1 * | 9/2003 | Azima | H04R 1/24 381/152 |
| 7,212,647 | B2 * | 5/2007 | Kaneda | H04R 9/02 381/345 |
| 2002/0076078 | A1 | 6/2002 | Kobayashi et al. | |
| 2013/0083958 | A1 | 4/2013 | Katz et al. | |

FOREIGN PATENT DOCUMENTS

| | | |
|---|---|---|
| JP | 2002-186080 | 6/2002 |
| JP | 2012-114664 | 6/2012 |
| JP | 2013-118545 | 6/2013 |
| WO | WO 2013/093552 | 6/2013 |

OTHER PUBLICATIONS

Supplementary European Search Report with Search Opinion for corresponding EP Application No. EP15846379.4, dated Dec. 12, 2017.

* cited by examiner

EXCITER

TECHNICAL FIELD

The present invention relates to an exciter. More specifically, the present invention relates to an exciter that can reproduce a high-frequency sound with high quality.

BACKGROUND ART

Typically, a speaker is used to output an acoustic signal as a sound so that the listener can listen to the acoustic signal. A speaker has a function of converting an acoustic signal (electrical signal) into air vibration (physical vibration). A speaker called cone type is known as a commonly used speaker.

FIG. 5 is a side sectional view showing an example of a cone speaker. A cone speaker 100 includes a first yoke 101, a ring magnet 102, and a second yoke 103. The first yoke 101 includes a bottom 101*a* and a cylinder 101*b*. The bottom 101*a* is in the shape of a disc. The cylinder 101*b* is formed integrally with the central portion of the bottom 101*a*. The ring magnet 102 and second yoke 103 have annular shapes. The ring magnet 102 has, in the center thereof, an opening 102*a* having a larger diameter than the cylinder 101*b* of the first yoke 101. The second yoke 103 has, in the center thereof, an opening 103*a* having a diameter smaller than the opening 102*a* of the ring magnet 102 and larger than the cylinder 101*b* of the first yoke 101.

The cone speaker 100 also includes a frame 104, a voice coil bobbin 106, a cone 108, and a dome 109. The frame 104 is mounted on the second yoke 103. The voice coil bobbin 106 has a cylindrical shape. The voice coil bobbin 106 is mounted to the frame 104 through a damper 105. The cone 108 is mounted to one end, 106*a*, of the voice coil bobbin 106. The cone 108 is also mounted to the frame 104 through an edge 107. The dome 109 is disposed so as to cover an opening at the end 106*a* of the voice coil bobbin 106.

As shown in FIG. 5, the ring magnet 102 is stacked on the first yoke 101. The second yoke 103 is stacked on the ring magnet 102. The first yoke 101, ring magnet 102, and second yoke 103 are coaxially arranged. The ring magnet 102 has the opening 102*a* in the center thereof. The second yoke 103 also has the opening 103*a* in the center thereof. The first yoke 101 has the cylinder 101*b* in the center thereof. The cylinder 101*b* is disposed so as to penetrate through the opening 102*a* of the ring magnet 102 and the opening 103*a* of the second yoke 103. An edge 104*a* of the frame 104 is mounted on an open surface (a surface opposite to a surface in contact with the ring magnet 102) 103*b* of the second yoke 103. The frame 104 is approximately in the shape of a mortar and is increased in diameter as it extends from the portion thereof (the edge 104*a*) mounted on the open surface 103*b* of the second yoke 103 upward in FIG. 5. The frame 104 also has a large opening 104*b* at another edge thereof.

The frame 104 has, in the opening 104*b*, an edge 107 for mounting the cone 108 on the frame 104 without significantly reducing the vibration of the cone 108. The cone 108 is supported by the frame 104 through the edge 107 mounted to the outer edge of the cone 108.

The cone 108 consists of bowl-shaped cone paper formed of pulp or the like. Due to the vibration of the cone paper, an acoustic signal can be converted into air vibration. The cone 108 has the cylindrical voice coil bobbin 106 mounted on the bowl-shaped bottom of the cone 108 in such a manner that the voice coil bobbin 106 contains the cylinder 101*b* of the first yoke 101. Note that a gap is provided between the inner surface of the voice coil bobbin 106 and the outer surface of the cylinder 101*b*. Gaps are also provided between the outer surface of the voice coil bobbin 106 and the inner surface of the second yoke 103 (the inner circumferential surface of the opening 103*a*) and between the outer surface of the voice coil bobbin 106 and the inner surface of the ring magnet 102 (the inner circumferential surface of the opening 102*a*).

The outer surface of the other edge, 106*b*, of the voice coil bobbin 106 facing the inner surface of the second yoke 103 is provided with a voice coil 110 for passing an acoustic signal. The voice coil bobbin 106 also has the damper 105 mounted thereto. The voice coil bobbin 106 is mounted to the frame 104 through the damper 105. Thus, vibration generated by the voice coil 110 can be transmitted to the cone 108 without significantly reducing the vibration of the voice coil bobbin 106.

The dome 109 is disposed in the opening at the end 106*a* of the voice coil bobbin 106. The dome 109 consists of cone paper, silk, or the like. Due to the vibration of the dome 109, an acoustic signal can be converted into air vibration.

An acoustic signal is inputted to the voice coil 110 of the cone speaker 100 thus configured. Due to the input of the acoustic signal, the voice coil bobbin 106 vibrates so as to vertically move toward the opening of the frame 104 (so as to reciprocate in the direction in which the voice coil bobbin 106 extends). The vibration of the voice coil bobbin 106 is transmitted to the cone 108 and dome 109 so as to vibrate the cone 108 and dome 109. Due to the vibration of the cone 108 and dome 109, the acoustic signal is converted into air vibration, and a sound is outputted forward of the cone speaker 100.

On the other hand, a speaker called exciter is known (for example, see Patent Literature 1). An exciter outputs a sound by vibrating a flat diaphragm or the like rather than vibrating the cone 108 and dome 109.

FIG. 6 is a side sectional view showing an example of an exciter 200 installed on a flat plate 220. The exciter 200 includes a first yoke 201, a disc-shaped magnet 202, and a second yoke 203. The first yoke 201 is in the shape of a cylinder having a bottom and serves as the bottom of the exciter 200. The disc-shaped magnet 202 is stacked in the center inside the first yoke 201. The second yoke 203 is in the shape of a disc and is stacked on the disc-shaped magnet 202. The diameters of the disc-shaped magnet 202 and second yoke 203 are smaller than the inner diameter of the cylindrical first yoke 201. Gaps are formed between the inner surface 201*a* of the first yoke 201, and the outer surfaces of the disc-shaped magnet 202 and second yoke 203 facing the inner surface 201*a*.

A cylindrical frame 205 having a ceiling is disposed above the first yoke 201 in such a manner that a ceiling surface 205*a* covers an open end of the cylindrical first yoke 201. An open lower end 205*b* of the cylindrical frame 205 is provided with a damper 207 for mounting the first yoke 201 to the frame 205. As shown in FIG. 7, the damper 207 consists of multiple legs 207*c* approximately in the shape of S. One end, 207*a*, of each leg 207*c* approximately in the shape of S is connected to the lower end 205*b* of the cylindrical frame 205. The other end, 207*b*, of each leg 207*c* is connected to the side of the first yoke 201. The damper 207 is formed of an elastic plate member. The use of the legs 207*c* approximately in the shape of S allows the vibration of the first yoke 201, disc-shaped magnet 202, and second yoke 203 to be transmitted to the frame 205 while preventing a reduction in the vibration as much as possible.

One end, 210*a*, of a cylindrical voice coil bobbin 210 is fixed to a portion of the ceiling surface 205*a* of the frame 205. The other end, 210*b*, of the voice coil bobbin 210 extends into the gaps between the inner surface of the first yoke 201 and the outer surfaces of the disc-shaped magnet 202 and second yoke 203. The outer circumferential surface of the extending other end, 210*b*, facing the inner surface 201*a* of the first yoke 201 is provided with a voice coil 211.

An acoustic signal is inputted to the voice coil 211 of the exciter 200 thus configured. Due to the input of the acoustic signal, the first yoke 201, disc-shaped magnet 202, and second yoke 203 vibrate. By transmitting the vibration of the first yoke 201 and the others to the frame 205 through the damper 207, it is possible to vibrate the flat plate 220 and the like and to output a sound.

The use of the exciter 200 allows the entire transmission medium in contact with the exciter 200, such as the flat plate 220, to emit a sound. Thus, it is possible to increase the spread of a sound and to improve sound quality. Further, by selecting the material or shape of the transmission medium for outputting a sound, it is possible to output deep bass, which is difficult to reproduce with only the cone speaker 100, without having to use a low-frequency speaker (woofer) or the like.

CITATION LIST

Patent Literature

PTL 1: Japanese Unexamined Patent Application Publication No. 2013-118545

SUMMARY OF INVENTION

Technical Problem

If the exciter 200 is installed on a transmission medium (member), a sound is outputted through the transmission medium. For this reason, the transmission medium must be able to support the self-weight or vibration force of the exciter 200, and many transmission media have certain levels of weight and strength. If the exciter 200 is installed on a transmission medium having such weight and strength and micro-vibration such as a high-frequency sound is transmitted to the transmission medium, the surface of the transmission medium can transmit such micro-vibration. However, there is a problem that it is difficult to represent fine-grained sound quality using the micro-vibration of the surface.

As a method for compensating for the lack of the ability to reproduce a high-frequency sound, there has been used a method involving installing a high-frequency speaker (tweeter) 214 (see FIG. 6) around the exciter 200, arranging acoustic signal input lines (not shown) leading to the exciter 200 in parallel, and inputting acoustic signals to both the exciter 200 and high-frequency speaker 214. The use of both the exciter 200 and high-frequency speaker 214 in this manner allows the exciter 200 to reproduce the spread of a mid/low-frequency sound, as well as allows the high-frequency speaker 214 to reproduce a high-frequency sound, which is difficult to reproduce using the exciter 200.

However, the use of both the exciter 200 and high-frequency speaker 214 in this manner requires the high-frequency speaker 214, resulting in a problem of an increase in cost. There are also other problems, including: the securing of a space for installing the high-frequency speaker 214, a reduction in the degree of installation freedom resulting from the installation of a low-pass filter and high-pass filter associated with the parallel arrangement of the input lines; and an increase in parts number associated with the installation of required connection leads.

The present invention has been made in view of the foregoing, and an object thereof is to provide an exciter that can output a high-frequency sound with high quality without having to provide a high-frequency speaker or the like in addition to the exciter.

Solution to Problem

To solve the above problems, an exciter of one aspect of the present invention includes a vibrator including a yoke and a magnet, a frame incorporating the vibrator so as to support the vibrator through a damper in such a manner that the vibrator can vibrate, and a cylindrical voice coil bobbin disposed in the frame and having one end mounted on the frame and another end extending to near the vibrator, the another end being provided with a voice coil. The exciter can output a sound through a transmission medium having the frame disposed thereon when the vibrator vibrates in response to an acoustic signal flowing through the voice coil and vibration of the vibrator is transmitted to the frame through the damper. The frame has an opening. An outer circumferential surface of the one end of the voice coil bobbin is mounted on an edge of the opening in such a manner that inside of the cylindrical voice coil bobbin is opened to outside of the frame from the opening. A vibrating member is disposed so as to cover an opened portion of the one end of the voice coil bobbin.

According to the above exciter, the voice coil bobbin is mounted on the edge of the opening in such a manner that the inside of the cylindrical voice coil bobbin is opened to the outside of the frame from the opening. The vibrating member is disposed so as to cover the opened portion of the voice coil bobbin. Thus, it is possible to transmit the vibration of the voice coil to the vibrating member through the voice coil bobbin and to output a sound from the vibrating member toward the outside of the frame.

A typical exciter transmits the vibration of a vibrator to a transmission medium so that the transmission medium outputs a sound. Accordingly, it has difficulty in outputting a fine-grained, high-frequency sound. The above exciter, on the other hand, can output a high-frequency sound through the vibrating member disposed on the voice coil bobbin rather than reproducing a high-frequency sound by only transmitting vibration to a transmission medium. Thus, the exciter can output a fine-grained, high-frequency sound and reproduce a high-frequency sound with high quality.

Also, unlike a conventional exciter, this exciter eliminates the need to additionally provide a high-frequency speaker or the like for reproducing a high-frequency sound. Thus, it is possible to solve problems, such as the securing of a space for installing a high-frequency speaker, an increase in parts number, and an increase in cost.

In the exciter, an outer surface of the frame may be covered by a sound absorber.

If the frame has an opening and the voice coil bobbin is mounted on the edge of the opening, the micro-vibration of the voice coil bobbin may be transmitted to the frame, resulting in the occurrence of noise from the outer surface of the frame. For this reason, in the exciter, the outer surface of the frame is covered by the sound absorber. Thus, it is possible to suppress noise that may occur from the outer surface of the frame.

In the exciter, the edge of the opening may be provided with a damping member, and the voice coil bobbin may be mounted to the edge of the opening through the damping member.

As described above, if the frame has an opening and the voice coil bobbin is mounted on the edge of the opening, the micro-vibration of the voice coil bobbin may be transmitted to the frame, resulting in the occurrence of noise from the outer surface of the frame. On the other hand, by providing the edge of the opening with the damping member and mounting the voice coil bobbin to the edge of the opening through the damping member, the micro-vibration of the voice coil bobbin is reduced by the damping member. Thus, it is possible to prevent the transmission of the micro-vibration of the voice coil bobbin to the frame and to prevent the occurrence of noise from the outer surface of the frame.

In the exciter, the voice coil bobbin may be provided with a heat dissipating member for dissipating heat accumulated in an internal space of the frame through the voice coil bobbin. By providing such a heat dissipating member, the heat dissipation performance of the inside of the exciter can be improved.

Advantageous Effects of Invention

According to the exciter of the present invention, the voice coil bobbin is mounted on the edge of the opening in such a manner that the inside of the cylindrical voice coil bobbin is opened to the outside of the frame from the opening. The vibrating member is disposed so as to cover the opened portion of the voice coil bobbin. Thus, it is possible to transmit the vibration of the voice coil to the vibrating member through the voice coil bobbin and to output a sound from the vibrating member toward the outside of the frame.

The exciter of the present invention can output a high-frequency sound through the vibrating member disposed on the voice coil bobbin rather than reproducing a high-frequency sound by only transmitting vibration to a transmission medium. Thus, the exciter can output a fine-grained, high-frequency sound and reproduce high-frequency sound with high quality.

Further, unlike a conventional exciter, this exciter eliminates the need to additionally provide a high-frequency speaker or the like for reproducing a high-frequency sound. Thus, it is possible to solve problems, such as the securing of a space for installing a high-frequency speaker, an increase in parts number, and an increase in cost.

DESCRIPTION OF EMBODIMENTS

Now, an exciter of the present invention will be described in detail using examples thereof.

First Embodiment

Figure 1:
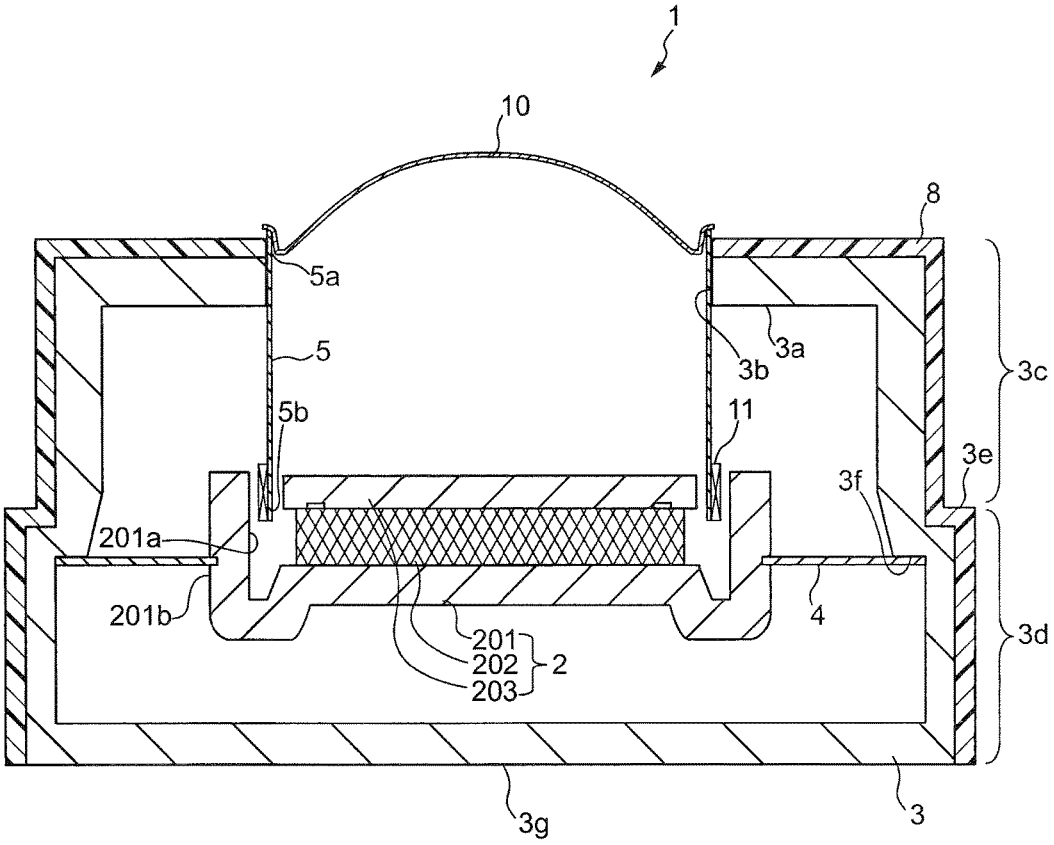
FIG. 1 is a side sectional view showing an exciter of a first embodiment.

FIG. 1 is a side sectional view showing a schematic configuration of an exciter of a first embodiment. In the description below, elements having the same functions as those of the exciter 200 described above are given the same reference signs.

As shown in FIG. 1, an exciter 1 of the first embodiment includes a vibrator 2, a frame 3, a damper 4, a voice coil bobbin 5, and a vibrating member 10. The frame 3 is an approximately cylindrical hollow body having, in a ceiling surface 3*a*, an opening 3*b* corresponding to the outer diameter of the voice coil bobbin 5. A lower cylindrical part 3*d* of the frame 3 has a larger width than an upper cylindrical part 3*c* thereof. The frame 3 has a step 3*e* approximately in the center of the outer circumference thereof.

The outer circumferential surface and outer ceiling surface of the frame 3 (the outer surfaces of the frame 3) are covered by a sound absorber 8. The sound absorber 8 has a function of suppressing (attenuating) unwanted vibration or the like (hereafter referred to as unwanted components) transmitted from the inside to the surface of the frame 3. The sound absorber 8 may be a vibration absorber such as urethane. The sound absorber 8 may also be a damping material obtained by bonding butyl rubber or the like to an aluminum sheet for suppressing vibration itself.

Figure 7:
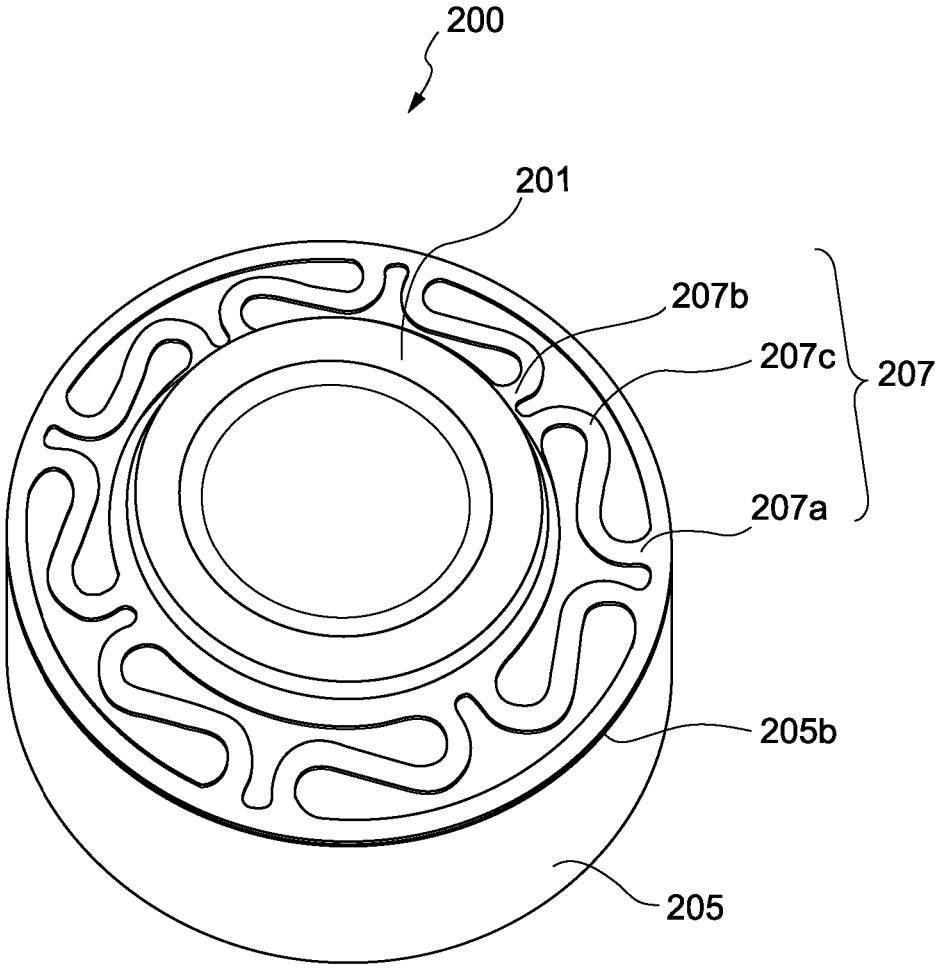
PRIOR ART FIG.7
FIG. 7 is a perspective view showing the rear side of the exciter shown in FIG. 6.

A step 3*f* corresponding to the step 3*e* on the outer circumference is formed approximately in the center inside the frame 3. The step 3*f* has the damper 4 mounted thereon. The damper 4 has a structure similar to that of a damper 207 shown in FIG. 7. The damper 4 consists of multiple legs approximately in the shape of S. One end of each approximately S-shaped leg is connected to the step 3*f* of the frame 3, and the other end thereof is connected to the side of the vibrator 2. The damper 4 is formed of an elastic plate member. The use of the approximately S-shaped legs allows the vibration of the vibrator 2 to be transmitted to the frame 3 while preventing a reduction in the vibration as much as possible.

Figure 6:
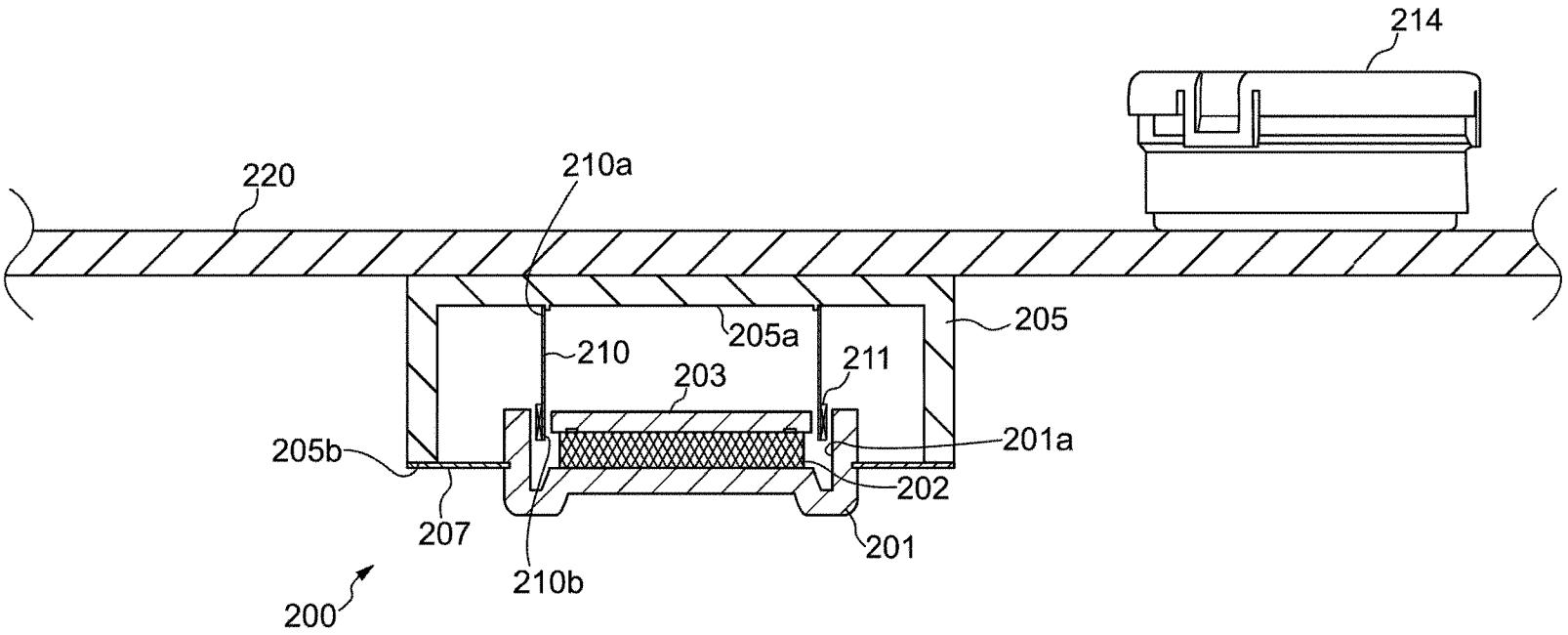
PRIOR ART FIG.6
FIG. 6 is a side sectional view showing an example in which a conventional known exciter is installed on a flat plate.

The vibrator 2 mostly consists of the first yoke 201, the disc-shaped magnet 202, and the second yoke 203 described with reference to FIG. 6. The first yoke 201 is in the shape of a cylinder having a bottom. The disc-shaped magnet 202 is stacked in the center of the inner bottom of the first yoke 201. The second yoke 203 is stacked on the disc-shaped magnet 202. As with the disc-shaped magnet 202, the second yoke 203 has a disc-shaped flat surface. The diameter of the second yoke 203 is slightly larger than that of the disc-shaped magnet 202. The inner diameter of the cylindrical first yoke 201 is larger than the diameters of the disc-shaped magnet 202 and second yoke 203. Gaps are formed between the inner surface 201*a* of the first yoke 201 and the outer surfaces of the disc-shaped magnet 202 and second yoke 203 facing the inner surface 201*a*. Due to the configuration of the vibrator 2 described above, the damper 4 is mounted to the side 201*b* of the first yoke 201.

The voice coil bobbin 5 is mounted on the edge of the opening 3*b* formed in the ceiling surface 3*a* of the frame 3. Specifically, the outer circumferential surface of an end 5*a* of the voice coil bobbin 5 and the edge of the opening 3*b* of the frame 3 are in contact with each other. The outer circumferential surface of the voice coil bobbin 5 is laterally fixed to the edge of the opening 3*b* of the frame 3. By fixing the voice coil bobbin 5 to the frame 3 in this manner, the cylindrical voice coil bobbin 5 is mounted in such a manner that the inside thereof is opened to the outside of the frame 3 from the opening 3*b*.

The voice coil bobbin 5 is fixed in such a manner that the end 5*a* thereof protrudes slightly upward from the upper surface of the ceiling of the frame 3. The vibrating member 10 for use in the dome of a high-frequency speaker (tweeter) or the like is mounted on the protruding end 5*a* of the voice coil bobbin 5. The vibrating member 10 is formed of, for example, silk in the shape of a dome. The vibrating member 10 is mounted so as to cover the opened portion of the voice coil bobbin 5.

The other end, 5*b*, of the voice coil bobbin 5 is disposed directly below the end 5*a* and extends into the gaps between the inner surface 201*a* of the first yoke 201 and the outer surfaces of the disc-shaped magnet 202 and second yoke 203. The outer circumferential surface of the extending other end, 5*b*, of the voice coil bobbin 5 facing the inner surface 201*a* of the first yoke 201 is provided with a voice coil 11.

Figure 2:
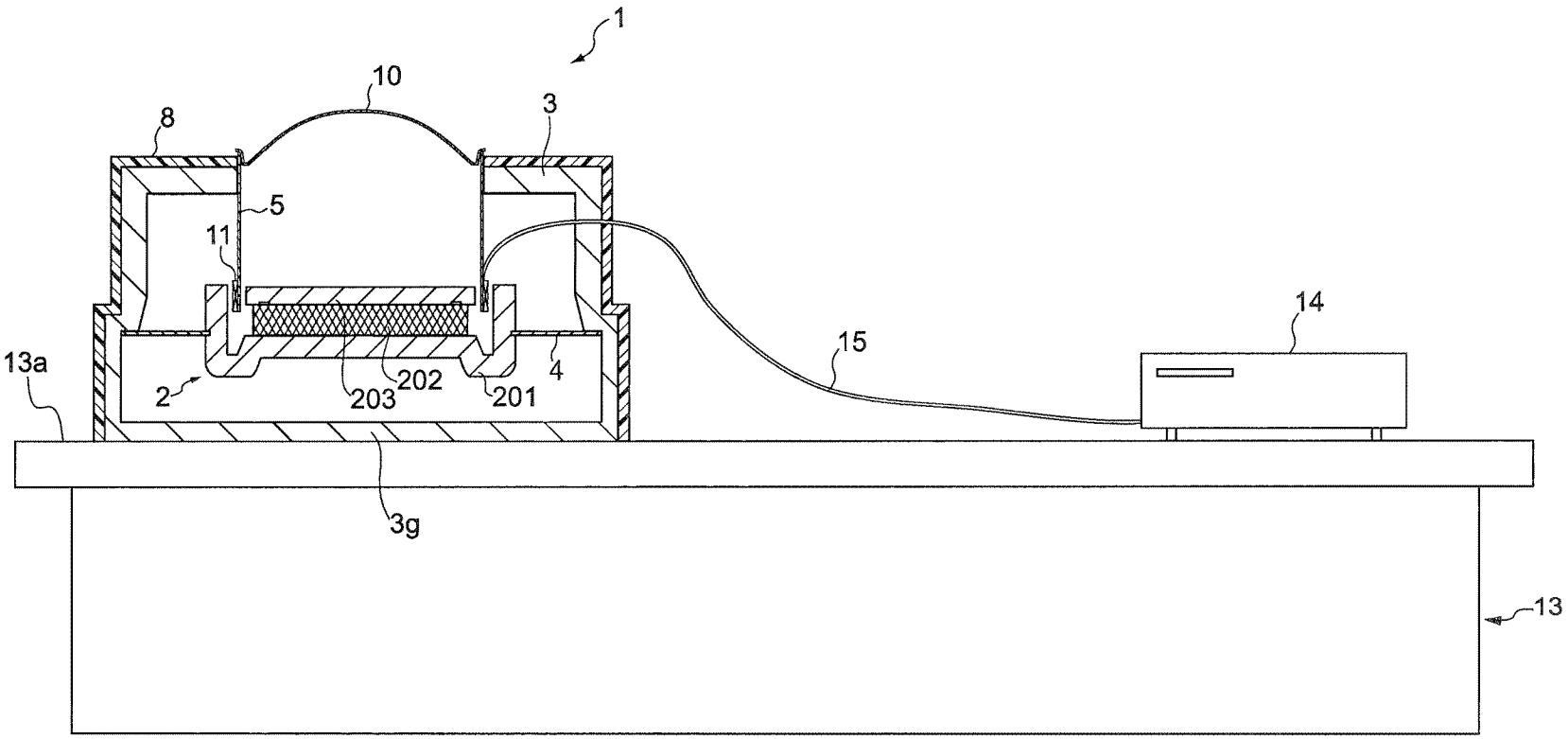
FIG. 2 is a diagram showing an example in which the exciter of the first embodiment is installed on a table.

FIG. 2 shows an example in which the exciter 1 is installed on a table 13. The bottom 3*g* of the frame 3 of the exciter 1 is fixed to a surface 13*a* of the table 13 using, for example, a double-sided tape. An acoustic signal reproducing device (e.g., a CD player) 14 having an amplification function is installed, for example, in a position slightly distant from the exciter 1 on the surface 13*a*. An output of the acoustic signal reproducing device 14 and an end of the signal cable of the voice coil 11 are electrically connected through a speaker cable 15. With the exciter 1 installed on the surface 13*a* of the table 13 in this manner, the acoustic signal reproducing device 14 outputs an acoustic signal to the voice coil 11. When the voice coil 11 receives the acoustic signal, the voice coil bobbin 5 vibrates vertically (reciprocates in the direction in which it extends) due to the conduction of the acoustic signal by the voice coil 11 and a magnetic field generated by the disc-shaped magnet 202. The vibrator 2 also vibrates vertically.

Due to the vertical vibration of the vibrator 2, the vibration of the acoustic signal is transmitted to the frame 3 through the damper 4. The vibration transmitted to the frame 3 is transmitted to the entire surface 13*a* through the bottom 3*g* of the frame 3. Thus, the entire table 13 outputs a sound as a transmission member (transmission medium).

The vertical vibration of the voice coil bobbin 5 vibrates the vibrating member 10, such as silk, mounted on the end 5*a* of the voice coil bobbin 5. Thus, the acoustic signal (electrical signal) is converted into air vibration (physical vibration), and a sound is outputted (generated) through the vibrating member 10. Since the vibrating member 10 is formed of silk or the like, which is used in the dome of a high-frequency speaker, it can output a fine-grained, high-frequency sound, which is difficult to output or reproduce on the surface 13*a*, on the basis of the vibration of the vibrator 2 of the exciter 1.

Further, the outer circumferential surface and outer ceiling surface of the frame 3 are covered by the sound absorber 8. Thus, even when the vibration of the voice coil bobbin 5 is transmitted to the frame 3 through the edge of the opening 3*b*, the occurrence of noise based on unwanted components on the outer surfaces of the frame 3 can be suppressed. This can prevent the output of noise based on unwanted components from the surface of the frame 3 and thus can improve the quality of the output sound of the exciter 1.

As described above, the exciter 1 of the first embodiment can output a high-frequency sound with high quality thanks to the vibrating member 10 disposed on the end 5*a* of the voice coil bobbin 5, as does a high-frequency cone speaker. Also, the exciter 1 transmits the vibration of the vibrator 2 to the table 13 through the bottom 3*g* of the frame 3 and thus can output low/mid-frequency sounds more effectively. As seen above, the use of the exciter 1 of the first embodiment allows high-quality, low-to high-frequency sounds to be outputted in balance.

Further, the exciter 1 of the first embodiment can output a fine-grained, high-frequency sound, which is difficult to output or reproduce using a conventional exciter, without having to additionally provide a high-frequency speaker (tweeter) or the like. Thus, it is possible to produce an effect of preventing a cost increase associated with the installation of a high-frequency speaker or the like and eliminating the need to consider the securing of the installation space, or the like.

While the example in which silk or the like is used as the vibrating member 10 of the exciter 1 has been described above, a metal material such as aluminum may be used as the material of the vibrating member 10. The use of aluminum as the vibrating member 10 allows sound quality specific to aluminum to be obtained, as well as allows heat accumulated around the voice coil bobbin 5 to be released (dissipated) through the vibrating member 10 formed of aluminum.

To further improve heat dissipation performance, it is preferred to use a high heat-dissipation material, such as aluminum, as the vibrating member 10, as well as to use a high heat-dissipation material, such as aluminum, as the voice coil bobbin 5. For example, aluminum sheets having high heat dissipation characteristics may be used as the voice coil bobbin 5 and vibrating member 10. If aluminum sheets are used, it is possible to effectively dissipate heat accumulated around the voice coil bobbin 5 (more specifically, inside the frame 3) when the exciter 1 is outputting a sound, by transferring the heat to the vibrating member 10.

Second Embodiment

Next, an exciter of a second embodiment will be described. Elements having the same functions as those of the exciter 1 of the first embodiment are given the same reference signs and will not be described in detail.

Figure 3:
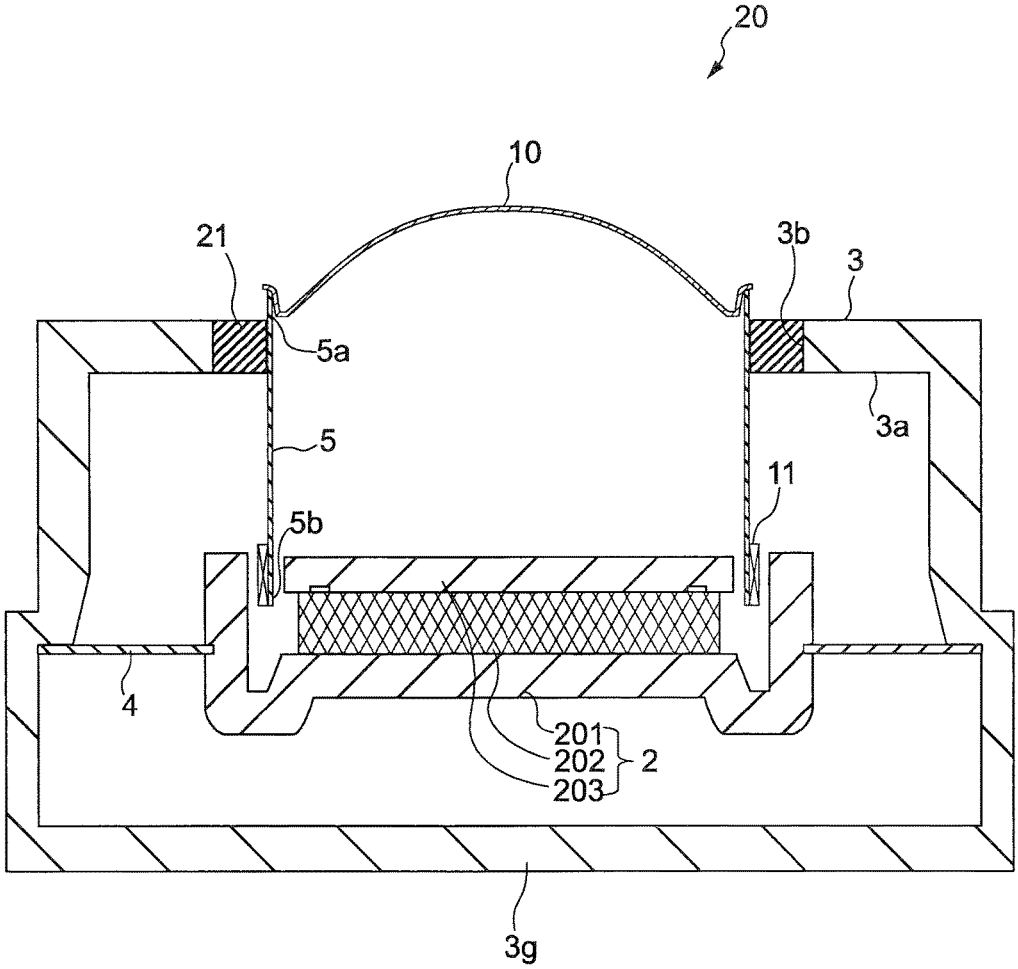
FIG. 3 is a side sectional view showing an exciter of a second embodiment.

FIG. 3 is a side sectional view showing an example of the exciter of the second embodiment. As shown in FIG. 3, in an exciter 20 of the second embodiment, a damping member 21 for absorbing the vibration of the voice coil bobbin 5 is disposed on the edge of the opening 3*b* formed in the ceiling surface 3*a* of the frame 3. The voice coil bobbin 5 is mounted to the damping member 21.

As seen above, the exciter 20 of the second embodiment differs from the exciter 1 of the first embodiment in that the voice coil bobbin 5 is mounted to the frame 3 through the damping member 21. The exciter 20 of the second embodiment also differs from the exciter 1 of the first embodiment in that a sound absorber 8 is not mounted on the outer circumferential surface and outer ceiling surface of the frame 3.

As shown in FIG. 3, in the exciter 20 of the second embodiment, the voice coil bobbin 5 is mounted to the frame 3 through the damping member 21 formed of a rubber member or the like. This can prevent the micro-vibration of the voice coil bobbin 5 from being transmitted to the frame 3 through the edge of the opening 3*b* and thus can prevent noise based on unwanted components from occurring on the surface of the frame 3 or the like due to the micro-vibration of the voice coil bobbin 5. As a result, the quality of an output sound of the exciter 20 can be improved.

Further, the damping member 21 can prevent unwanted components from being transmitted to the frame 3. This eliminates the need to mount a sound absorber 8 on the outer circumferential surface and outer ceiling surface of the frame 3 and thus allows for the simplification of the structure and a reduction in cost.

Third Embodiment

Next, an exciter of a third embodiment will be described. Elements having the same functions as those of the exciter 1 or 20 of the first or second embodiment are given the same reference signs and will not be described in detail.

Figure 4:
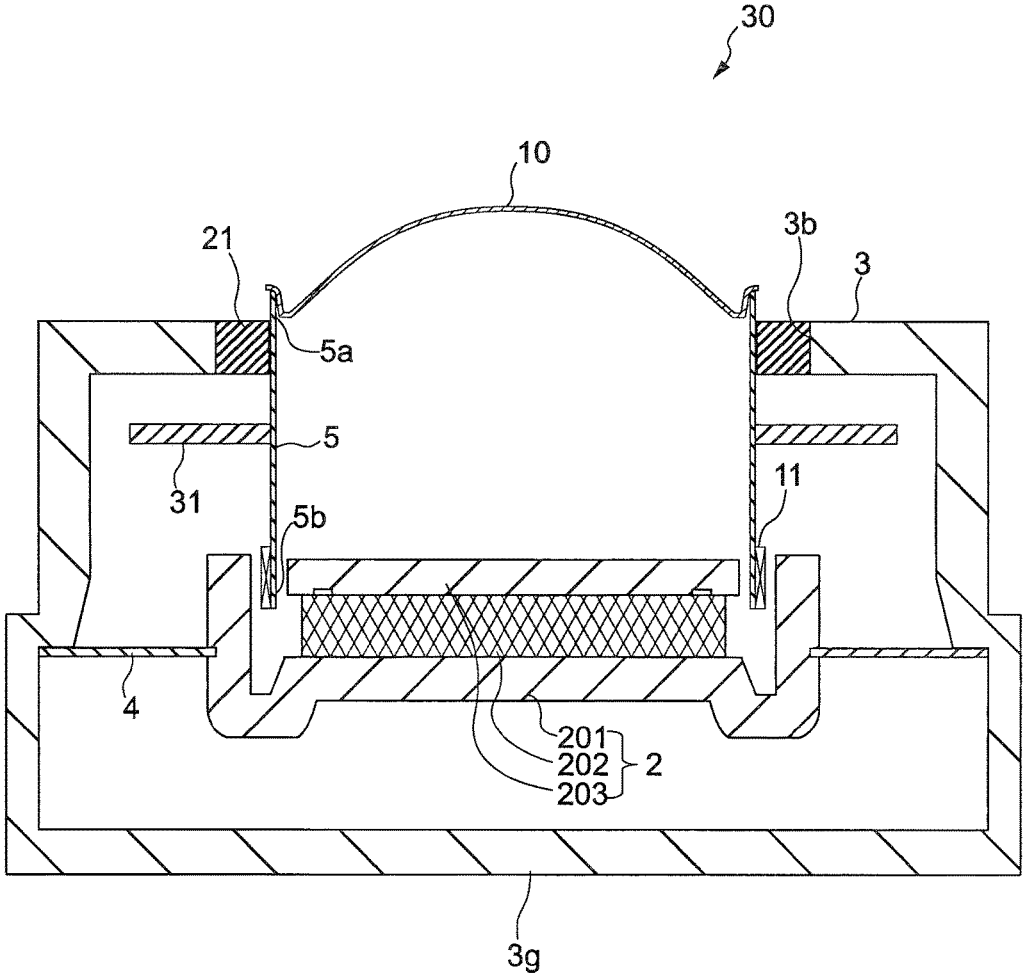
FIG. 4 is a side sectional view showing an exciter of a third embodiment.
Figure 5:
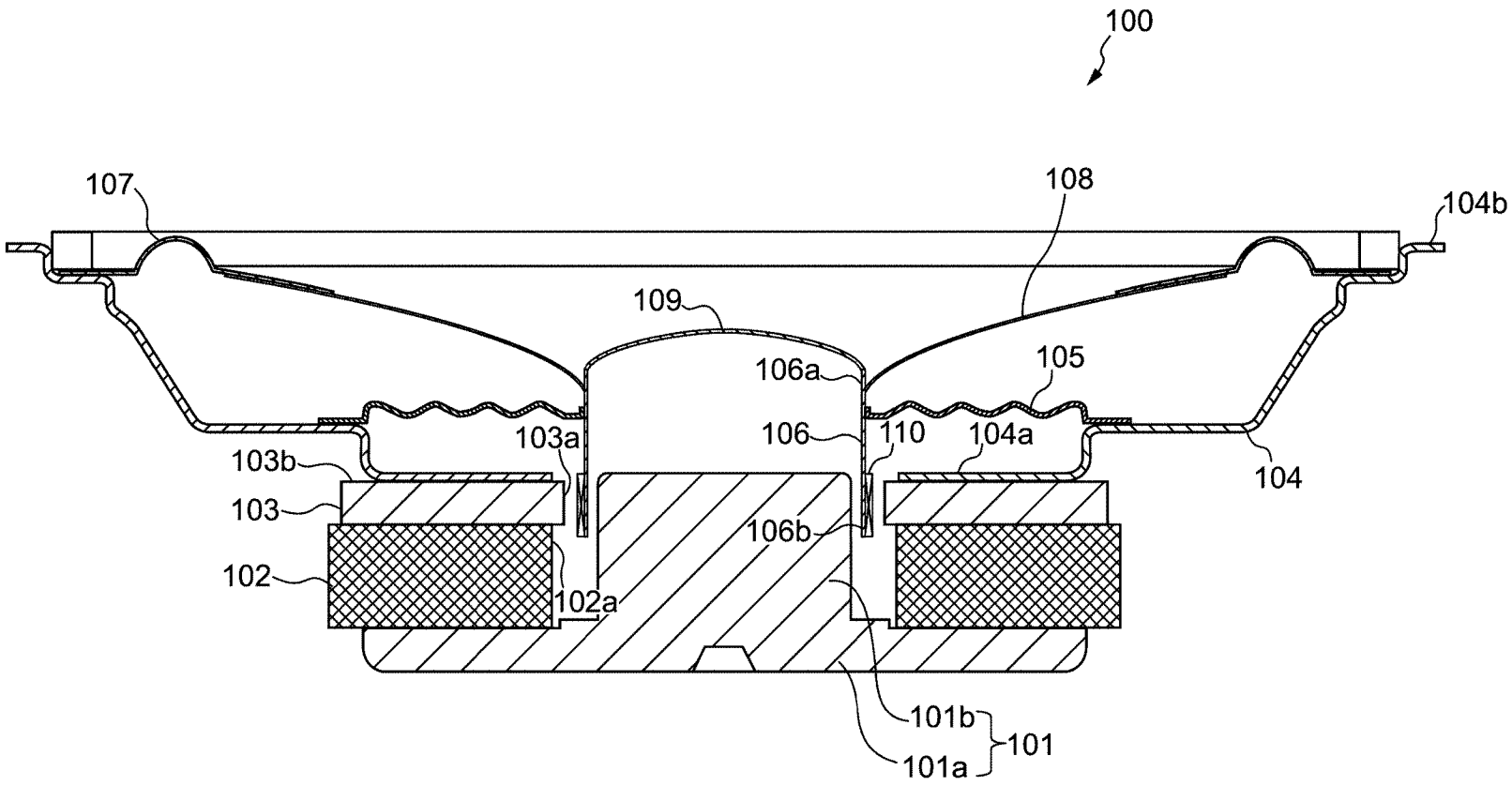
PRIOR ART FIG.5
FIG. 5 is a side sectional view showing a schematic configuration of a cone speaker.

FIG. 4 is a side sectional view showing an example of the exciter of the third embodiment. As shown in FIG. 4, an exciter 30 of the third embodiment has a structure in which an annular heat dissipating member 31 is disposed around the center of the outer circumferential surface of a voice coil bobbin 5. As seen above, the exciter 30 of the third embodiment differs from the exciters 1, 20 of the first and second embodiments in that the heat dissipating member 31 is disposed on the voice coil bobbin 5.

It is preferred to use a material that does not hamper the vibration of the voice coil bobbin 5, as the heat dissipating member 31 disposed on the voice coil bobbin 5. For example, a light-weight, high-heat dissipation member, such as an aluminum sheet, is preferably used as the heat dissipating member 31.

As shown in FIG. 4, the voice coil bobbin 5 is mounted to the frame 3 through the damping member 21. Thus, the vibration of the voice coil bobbin 5 itself is significantly restricted compared to a cone speaker. For example, there is a problem that heat is more likely to be accumulated in a space between the outer circumferential surface of the voice coil bobbin 5 and the inner surface of the frame 3. For this reason, the heat dissipating member 31 is disposed around the center of the outer circumferential surface of the voice coil bobbin 5 in the space between the voice coil bobbin 5 and frame 3. Thus, the heat dissipation performance of the inside of the exciter 30 can be improved.

To improve heat dissipation performance, it is preferred to dispose the heat dissipating member 31, as well as to use a high heat dissipation material as the voice coil bobbin 5 as described above. For example, if an aluminum sheet is used as the heat dissipating member 31, heat can be dissipated effectively by using aluminum also as the voice coil bobbin 5.

As described above, the exciters of the first to third embodiments include the hollow frame 3 having the bottom 3*g* for contacting the table 13 or the like (a transmission medium for outputting a sound) and having the opening 3*b* in the ceiling surface 3*a*. The vibrator 2 including the first yoke 201, disc-shaped magnet 202 and second yoke 203 is mounted to the inside of the frame 3 through the damper 4 so as to be capable of vibration. Thus, vibration associated with an acoustic signal can be transmitted to the table 13 or the like through the bottom 3*g*. As a result, the use of the exciters of the first to third embodiments allows the entire surface 13*a* of the table 13 to output low-to-high full frequency sounds.

The end 5*a* of the voice coil bobbin 5 is mounted on the opening 3*b* of the frame 3. The dome-shaped vibrating member 10 is disposed so as to cover the opened portion of the end 5*a* of the voice coil bobbin 5. The other end 5*b* of the voice coil bobbin 5 extends to near the second yoke 203, and the voice coil 11 is disposed on the outer circumferential surface of the other end 5*b*. Owing to this configuration, a high-frequency sound can be outputted by vibrating the vibrating member 10. In particular, silk or the like, which is used in the dome of a high-frequency speaker or the like, is used as the vibrating member 10. Thus, it is possible to output and reproduce a fine-grained, high-frequency sound, which is difficult to output or reproduce with only the vibration of the vibrator 2.

In the exciter 1 of the first embodiment, the outer circumferential surface and outer ceiling surface of the frame 3 (the outer surfaces of the frame 3) are covered by the sound absorber 8. This can prevent the micro-vibration of the voice coil bobbin 5 from being transmitted to the frame 3 and thus noise from occurring from the surface of the frame 3 or the like.

In the exciters 20, 30 of the second and third embodiments, the voice coil bobbin 5 is mounted to the frame 3 through the damping member 21 formed of a rubber member or the like. This can prevent the micro-vibration of the voice coil bobbin 5 from being transmitted to the frame 3 through the edge of the opening 3*b* and thus can prevent noise from occurring from the surface of the frame 3 or the like.

In the exciter 30 of the third embodiment, the heat dissipating member 31 is disposed around the center of the outer circumferential surface of the voice coil bobbin 5. Thus, the heat dissipation performance of the exciter 30 (voice coil bobbin 5) can be improved.

While the exciter of the present invention has been described in detail with reference to the drawings, the exciter of the present invention is not limited to the examples given in the first to third embodiments. It is apparent that those skilled in the art can conceive of various changes or modifications thereto without departing from the scope set forth in the claims.

For example, the configuration in which the heat dissipating member 31 is disposed in the exciter 20 of the second embodiment has been described as the exciter 30 of the third embodiment. However, the heat dissipating member 31 is not limited to be disposed only in the exciter 20 of the second embodiment. For example, the heat dissipating member 31 may be disposed in the exciter 1 of the first embodiment. Even if the heat dissipating member 31 is disposed in the exciter 1 of the first embodiment, the heat dissipation performance of the exciter 1 (voice coil bobbin 5) can be improved, as seen in the exciter 30 of the third embodiment.

REFERENCE SIGNS LIST

1, 20, 30, 200 exciter
2 vibrator
3, 104, 205 frame
4, 105, 207 damper
5, 106, 210 voice coil bobbin
3*a* ceiling surface (of frame)
3*b* opening (of frame)
3*c* upper cylindrical part (of frame)
3*d* lower cylindrical part (of frame)
3*e*, 3*f* step (of frame)
3*g* bottom (of frame)
5*a*, 210*a* end (of voice coil bobbin)
5*b*, 210*b* other end (of voice coil bobbin)
8 sound absorber
10 vibrating member
11, 110, 211 voice coil
13 table (transmission medium)
13*a* surface of table

14 acoustic signal reproducing device
15 speaker cable
21 damping member
31 heat dissipating member
100 cone speaker
101, 201 first yoke
101*a* bottom (of first yoke)
101*b* cylinder (of first yoke)
102 ring magnet
102*a* opening (of ring magnet)
103, 203 second yoke
103*a* opening (of second yoke)
103*b* open surface (of second yoke)
104*a* edge (of frame)
104*b* opening (of frame)
106*a* end (of voice coil bobbin)
106*b* end (of voice coil bobbin)
107 edge
108 cone
109 dome
201*a* inner surface (of first yoke)
201*b* side (of first yoke)
202 disc-shaped magnet
205*a* ceiling surface (of frame)
205*b* lower end (of frame)
207*a* one end (of damper)
207*b* other end (of damper)
207*c* multiple legs (of damper)
214 high-frequency speaker
220 flat plate

The invention claimed is:

1. An exciter comprising:
a vibrator comprising a yoke and a magnet;
a frame incorporating the vibrator so as to support the vibrator through a damper in such a manner that the vibrator can vibrate; and
a cylindrical voice coil bobbin disposed in the frame and having one end mounted on the frame and another end extending to near the vibrator, the another end being provided with a voice coil, wherein
the exciter can output a sound through a transmission medium having the frame disposed thereon when the vibrator vibrates in response to an acoustic signal flowing through the voice coil and vibration of the vibrator is transmitted to the frame through the damper,
a ceiling surface of the frame has an opening,
an outer circumferential surface of the one end of the voice coil bobbin is laterally fixed to and mounted on an edge of the opening provided in the ceiling surface of the frame in such a manner that inside of the cylindrical voice coil bobbin is opened to outside of the frame from the opening, and
a vibrating member is disposed so as to cover an opened portion of the one end of the voice coil bobbin.

2. The exciter according to claim 1, wherein an outer surface of the frame is covered by a sound absorber.

3. The exciter according to claim 1, wherein
the edge of the opening is provided with a damping member, and
the voice coil bobbin is mounted to the edge of the opening through the damping member.

4. The exciter according to claim 1, wherein the voice coil bobbin is provided with a heat dissipating member for dissipating heat accumulated in an internal space of the frame through the voice coil bobbin.

5. The exciter according to claim 1, wherein
the frame has a bottom opposite to the ceiling surface in a height direction of the exciter such that an entirety of the vibrator is provided between the ceiling surface and the bottom in the height direction.

6. An exciter comprising:
a vibrator comprising a yoke and a magnet;
a frame incorporating the vibrator so as to support the vibrator through a damper in such a manner that the vibrator can vibrate; and
a cylindrical voice coil bobbin disposed in the frame and having one end mounted on the frame and another end extending to near the vibrator, the another end being provided with a voice coil, wherein
the exciter can output a sound through a transmission medium having the frame disposed thereon when the vibrator vibrates in response to an acoustic signal flowing through the voice coil and vibration of the vibrator is transmitted to the frame through the damper,
the frame has an opening,
an outer circumferential surface of the one end of the voice coil bobbin is mounted on an edge of the opening in such a manner that inside of the cylindrical voice coil bobbin is opened to outside of the frame from the opening,
a vibrating member is disposed so as to cover an opened portion of the one end of the voice coil bobbin, and
an outer surface of the frame is covered by a sound absorber.

7. An exciter comprising:
a vibrator comprising a yoke and a magnet;
a frame incorporating the vibrator so as to support the vibrator through a damper in such a manner that the vibrator can vibrate; and
a cylindrical voice coil bobbin disposed in the frame and having one end mounted on the frame and another end extending to near the vibrator, the another end being provided with a voice coil, wherein
the exciter can output a sound through a transmission medium having the frame disposed thereon when the vibrator vibrates in response to an acoustic signal flowing through the voice coil and vibration of the vibrator is transmitted to the frame through the damper,
the frame has an opening,
an outer circumferential surface of the one end of the voice coil bobbin is mounted on an edge of the opening in such a manner that inside of the cylindrical voice coil bobbin is opened to outside of the frame from the opening,
a vibrating member is disposed so as to cover an opened portion of the one end of the voice coil bobbin, and
the voice coil bobbin is provided with a heat dissipating member for dissipating heat accumulated in an internal space of the frame through the voice coil bobbin.

* * * * *